US007240395B2

(12) United States Patent
Clarke et al.

(10) Patent No.: US 7,240,395 B2
(45) Date of Patent: Jul. 10, 2007

(54) DUAL MODE OUTDOOR VACUUM

(75) Inventors: Patrick J. Clarke, Bartlett, IL (US); Jesse V. Mondigo, Aurora, IL (US)

(73) Assignee: Minuteman International, Inc., Addison, IL (US)

( * ) Notice: Subject to any disclaimer, the term of this patent is extended or adjusted under 35 U.S.C. 154(b) by 789 days.

(21) Appl. No.: 10/699,085

(22) Filed: Oct. 31, 2003

(65) Prior Publication Data

US 2004/0093685 A1 May 20, 2004

Related U.S. Application Data

(60) Provisional application No. 60/423,908, filed on Nov. 4, 2002.

(51) Int. Cl.
*A47L 5/00* (2006.01)

(52) U.S. Cl. ..... 15/334; 15/338

(58) Field of Classification Search ..... None
See application file for complete search history.

(56) References Cited

U.S. PATENT DOCUMENTS 6,519,805 B2 * 2/2003 Firdaus et al. ..... 15/334

* cited by examiner

*Primary Examiner*—David Redding
(74) *Attorney, Agent, or Firm*—Wildman, Harrold, Allen & Dixon LLP

(57) ABSTRACT

A motor-driven outdoor vacuum has a ground level intake and a hose intake. When a hand-operable actuator moves a first or main door into a ground pick-up position, the ground level intake, which is carried by the first door is in direct air-flow communication with the impeller and the hose intake, which is carried by the first door is closed by a spring-actuated second door carried by the main door. When the actuator is moved to a hose intake position, the main door is moved to a second position in which the hose is in air-flow communication with the impeller and the ground level intake is closed.

9 Claims, 8 Drawing Sheets

DUAL MODE OUTDOOR VACUUM

RELATED APPLICATION

This application claims priority of co-owned U.S. provisional application Ser. No. 60/423,908 filed Nov. 14, 2002.

FIELD OF THE INVENTION

The present invention relates to vacuums of the type used for commercial, industrial, and residential outdoor applications. Vacuums of this type typically have two different operating modes. A first operating mode (the "ground pick-up" mode) has a ground-level intake in an open or active mode so that debris on a surface such as a floor, concrete slab or parking lot, or clippings on a lawn or garden area may be suctioned up and routed to a collection container. In a second mode of operation, the "hose intake" mode, a hose intake is in direct air-flow communication with a driven impeller which creates the suction, and the ground level intake is closed. In the hose intake mode, a flexible hose may be used to clean areas which are not conveniently accessible by the ground level intake, and dust and debris are routed to the collection container along the same general path and by the same suction source as with the ground-level intake.

BACKGROUND AND SUMMARY OF THE INVENTION

Some existing commercial dual mode outdoor vacuums require a mounting plate to assemble a hose connection to the impeller inlet and to block the ground level intake when it is desired to convert the machine to the hose intake mode. This design is inconvenient, first because the mounting plate must be located and then assembled to the housing for the conversion, which is time consuming and inconvenient. Second, many times, the desired use of the hose takes only a few minutes, after which the vacuum must be re-converted to the ground pick-up mode.

The present invention converts the vacuum between the ground pick-up mode and the hose intake mode without having to locate additional parts, or remove parts from the vacuum, assembly or any additional parts to the vacuum. Moreover, the present invention permits the conversion and re-conversion to be accomplished simply, quickly and reliably with one activation lever, and without having to shut off the suction motor. Still further, the present invention provides a conversion mechanism which is simple and economical to manufacture, yet durable and reliable, while being readily accessible to, and easily and reliably operable by the operator in a single, simple and safe conversion procedure.

The present invention includes a main door or flap pivotally mounted within the deck of the vacuum and rotatable between a ground pick-up position and a hose intake position by means of a simple lever or other manual actuating device. A hose connector is mounted directly to the main door Oct. 3, 2003 on with a hose inlet aperture in the main door.

When the main door is in the ground pick-up position, the ground level intake is in direct air-flow communication with the impeller (i.e. suction or "vacuum" device), and the hose intake is closed by a second door pivotally mounted to the main door. The second door is spring-biased to close the hose inlet aperture in the main door when the main door is in the ground pick-up position.

When the actuator is moved to the hose intake position, the hose is in direct air-flow communication with the impeller, and the ground level intake is cut off from the suction source by the main door with the same conversion lever without any need to move additional actuators or assemble or detach parts. In the hose intake position, the second door is opened by an actuator located adjacent an intermediate opening located between the impeller and the ground level intake.

The hose connection between the deck and the flexible hose is mounted to and carried by the main door so that the hose connector is moved with the main door between the two operating positions, thereby simplifying and maintaining the seal between the hose connector and the suction source (i.e. impeller) when the machine is placed in the hose intake position.

The present invention thus provides a simple, economical, and yet reliable mechanism for converting a vacuum machine between the two desired modes of operation with a single actuator for placing the vacuum in both modes of operation and eliminating separate parts and mounting procedures.

Other features and advantages will be apparent to persons skilled in the art from the following description and drawings wherein like numerals will refer to the same element in the various views.

DETAILED DESCRIPTION OF THE ILLUSTRATED EMBODIMENT

Figure 1:
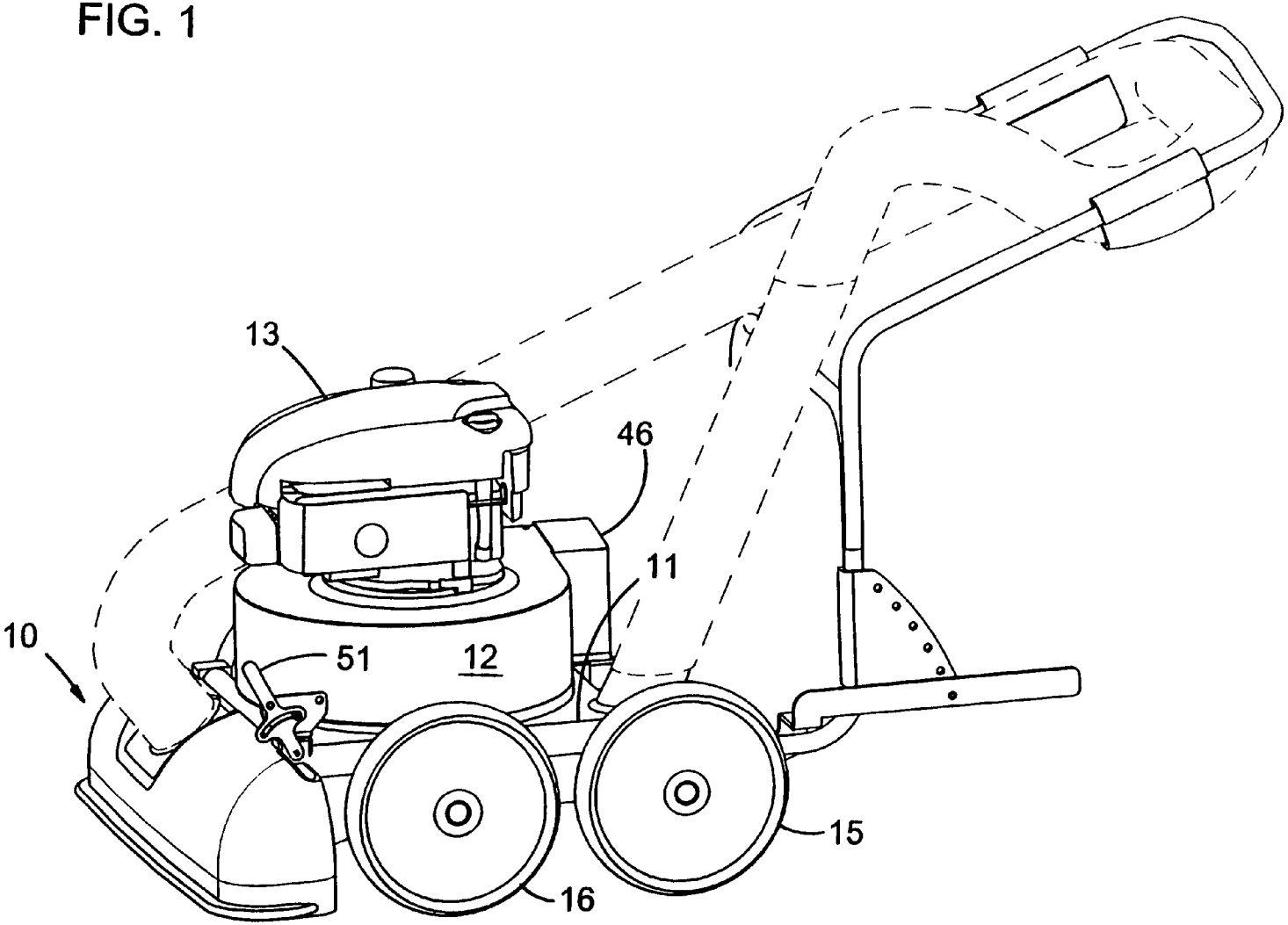
FIG. 1 is a perspective view, taken from the upper, front and left side of a vacuum pick-up machine incorporating the present invention and arranged in the hose intake mode.

Referring first to FIG. 1, reference numeral 10 generally designates a main housing. The housing 10 includes a deck generally designated 11 on top of which an impeller housing 12 is secured by bolts or the like. On top of the impeller housing 12 is mounted a conventional gasoline engine 13 including an output shaft 14 (FIGS. 4 and 7) which extends into the impeller housing 12.

The main housing 10 is provided with four ground support wheels, the two on the left side being shown in FIG. 1 and designated 15 and 16.

Figure 2:
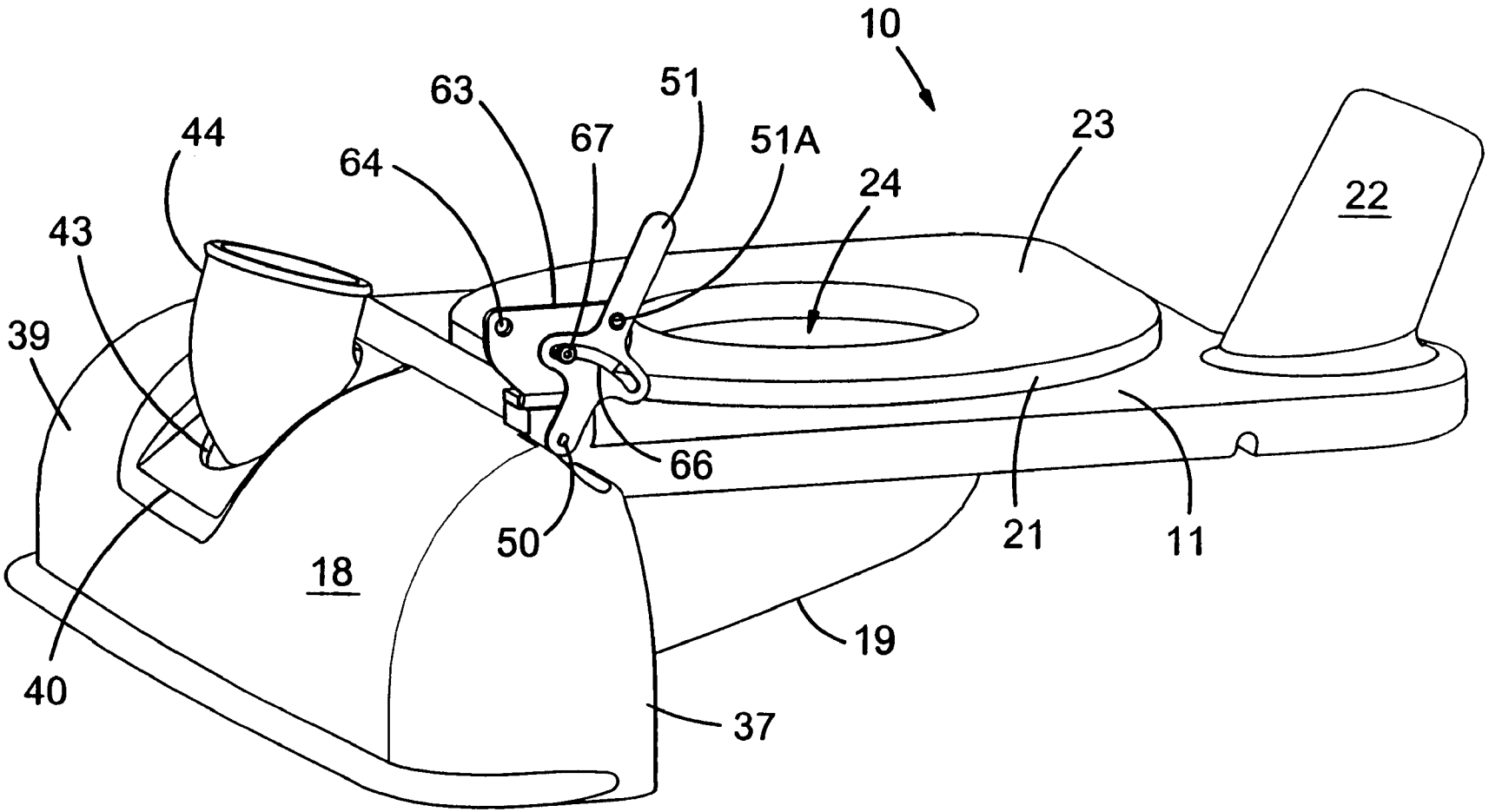
FIG. 2 is a perspective view taken from an angle similar to that of FIG. 1, of the snout and deck of the apparatus of FIG. 1 and arranged in the ground pick-up mode.
Figure 8:
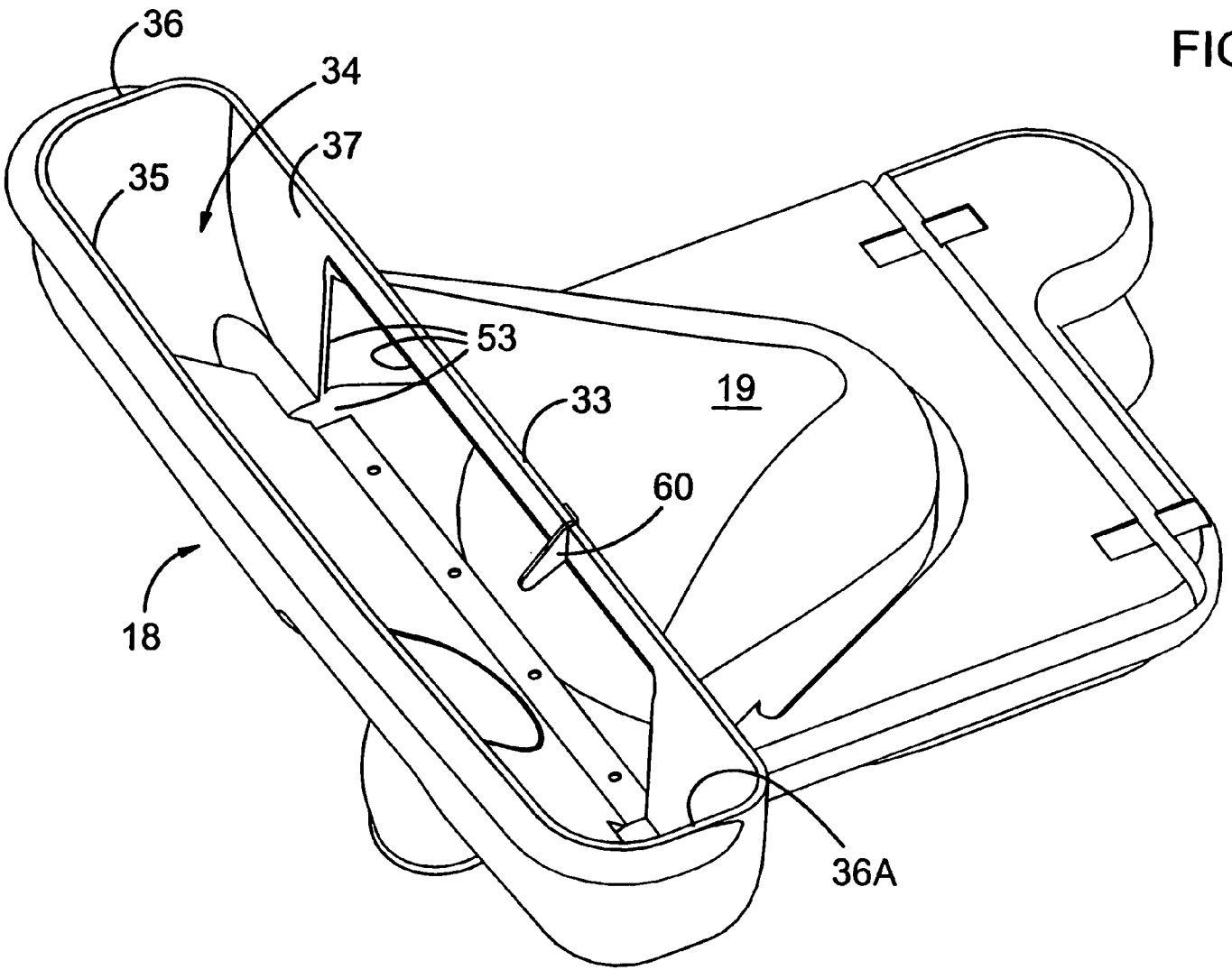
FIG. 8 is a perspective view of the bottom of the housing.

Turning now to FIGS. 2 and 8, the deck 11 is shown in more detail as including a forward section referred to as a "snout" and designated 18. A plenum 19 is formed beneath the deck 11 and to the rear of the snout 18. The snout 18, plenum 19 and deck 11 may all be molded as an integral unit.

Figure 3:
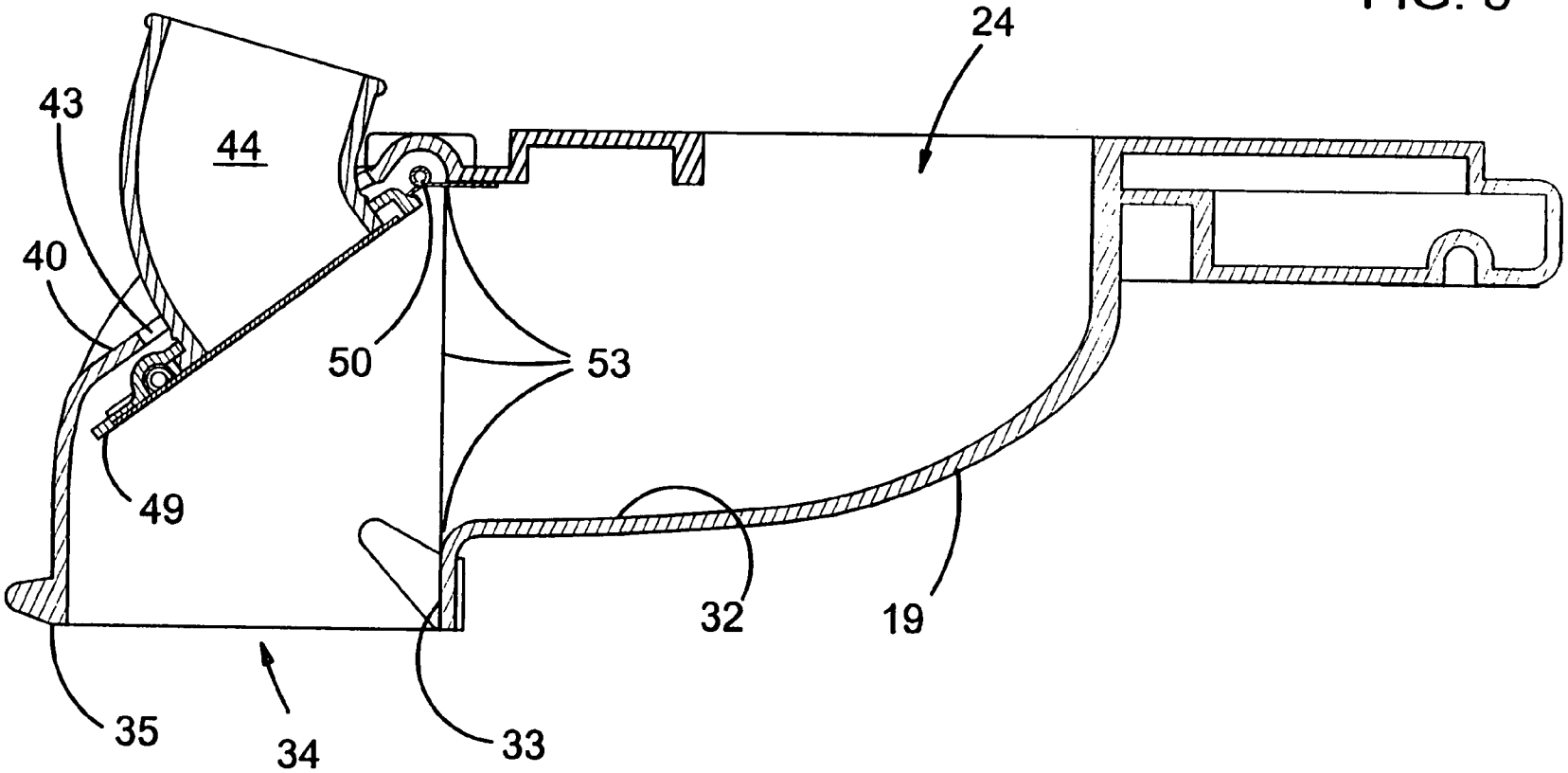
FIG. 3 is a vertical cross-sectional view of the structure shown in FIG. 2, taken through the front to rear center line of the housing.
Figure 4:
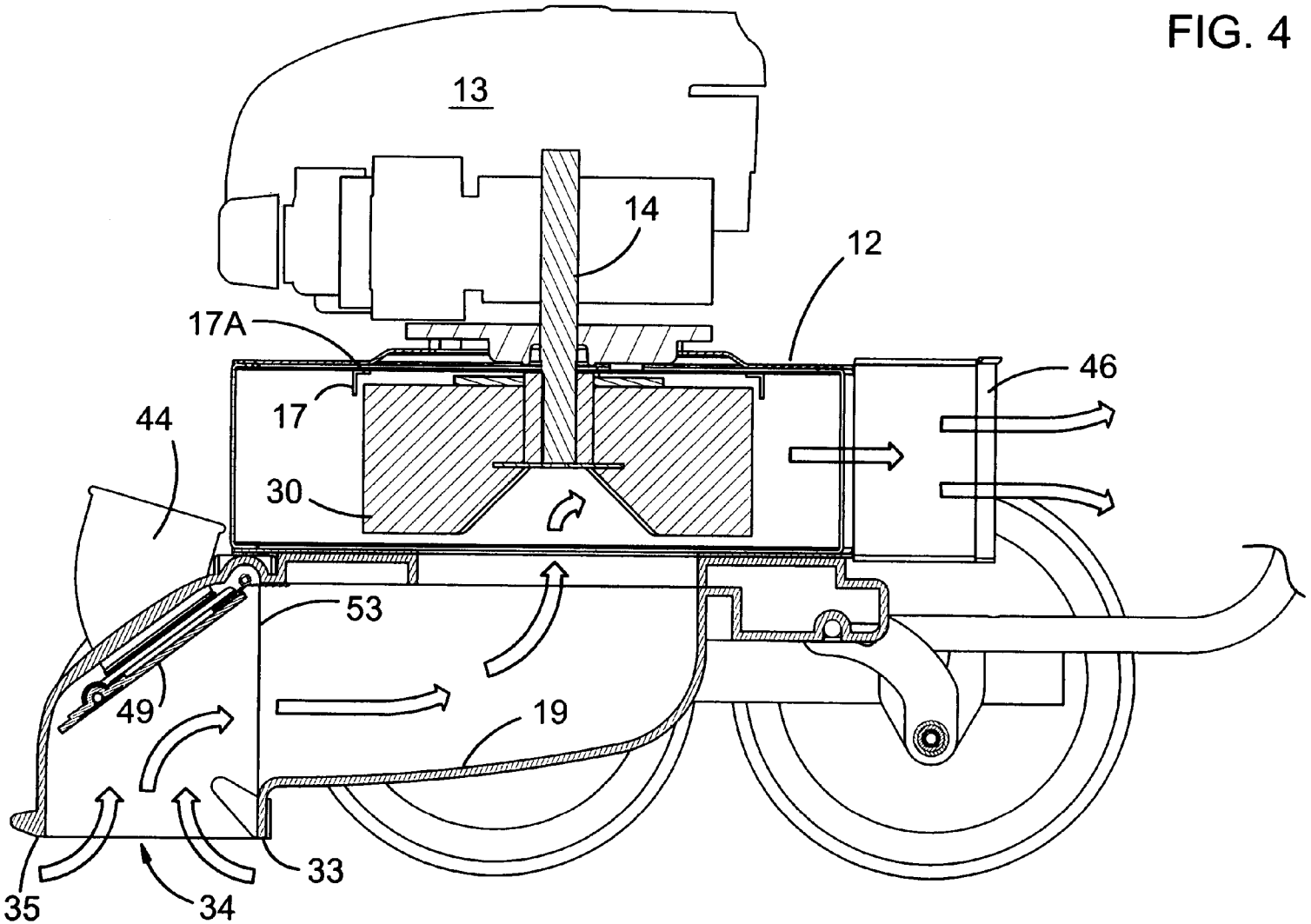
FIG. 4 is a left side cross sectional view of the apparatus shown in FIG. 1 with the handle in fragmentary form and with the machine in the ground pick-up mode.

Turning now to FIGS. 2 and 3, the deck 11 includes a platform or top wall 21 with a raised annular mounting surface 23 on which the impeller housing 12 is bolted. The annular mounting surface 23 defines a circular aperture 24 which communicates the plenum 19 with an impeller 30. The impeller, designated 30 in FIG. 4, is mounted to the shaft 14 of the motor 13 and lies within the impeller housing 12. As persons skilled in the art will appreciate, when the engine 13 is operated, it rotates the impeller 30 which, in turn, draws air and debris (illustrated by the arrows in FIG. 4) through a ground level intake opening 34, the plenum 19, and opening 24 and then exhausts the air and debris through a discharge chute 46 into a collection container (not illustrated for brevity).

A wrap protection member 17 in the form of a cylindrical wall extends down from the deck (to which the member is mounted by means of an annular ring 17A). The member 17 is spaced slightly from the blades of the impeller 30 and forms a wall which prevents plastic and other sheet material from entangling about the upper edges of the impeller blade.

A bottom wall of the plenum 19 is designated 32 in FIG. 3; and its forward edge is turned downwardly at 33 to define the rear edge of the intake opening generally designated 34.

The remainder of the intake opening 34 is defined by the lower edge 35 of the snout 18 which forms a generally rectangular opening which when viewed from the bottom as in FIG. 8, including side edges 36, 36A. It will be observed from FIG. 2 that the front left and right corners of the snout 18 are curved, and then extend rearwardly and slightly outwardly to form side walls which join the forward, side flanges of the plenum 19, such as the left side flange designated 37 in FIGS. 2 and 8.

The front wall of the snout 18, designated 39 is curved and forms a recess at 40 (FIGS. 2 and 3). An aperture 43 is formed in the recess 40 for receiving a hose connector generally designated 44 and in the form of an elbow conduit. The hose connector 44 is freely moveable and slidable in the opening 43, as will be understood from subsequent description. A flexible hose (shown in dashed line in FIG. 1) has one end connected to the hose connector 44. The hose may be removably secured to the handle of the machine when it is not in use, and the intake end mounted on a fixed spout 22 (FIG. 2) for securing the hose to the deck 11 when the hose is not in use.

Turning now to FIGS. 3 and 4 in particular, the fixed end of the hose connector 44 (i.e. the end remote from the end connected to the flexible hose), is mounted to a main door or door generally designated 49. The main door 49 is mounted to a shaft or pintle 50 which is journaled, at its sides, to a forward portion of the deck 11 (see FIGS. 5 and 6). An actuator in the form of a handle or lever 51 is mounted to rotate the shaft 50, and thus the main door 49 between two operating positions. One of the operating positions, seen in FIGS. 3 and 4, has the main door 49, rotated clockwise to a forward position, sometimes referred to as the ground pick-up position, in which air flows in the direction of the arrows in FIG. 4 through the ground level intake opening 34, the snout 18, the interior of the plenum 19, opening 24, and is forced by the impeller 30, through discharge chute 46. In this position, the main door engages and seals against the inside surface of the snout 18; and, as will be understood from further description, the inlet opening leading from the snout to the hose connector 44 is also shut. A gasket (not shown in the drawing) may be added to seal opening 43 in the ground pick-up mode.

The deck 11 defines an intermediate opening generally designated 53 (see FIGS. 3 and 8) located between the rear of the snout 18, and the forward portion of the plenum 19. In the illustrated embodiment, the intermediate opening 53 extends generally vertically above the forward lip 33 of the lower wall 32 of the plenum, but other locations are equally suitable. The intermediate opening 53 lies between the ground level intake opening 34 and the impeller 30. It will be apparent that the ground level intake opening is spaced slightly above the ground to permit suction air to flow into the vacuum machine. When the main door is moved to the hose intake position seen in FIG. 6, intermediate opening 53 is closed by the main door 49 and the ground level intake opening 34 is not in air-flow communication with the impeller, as will now become clear.

Figure 5:
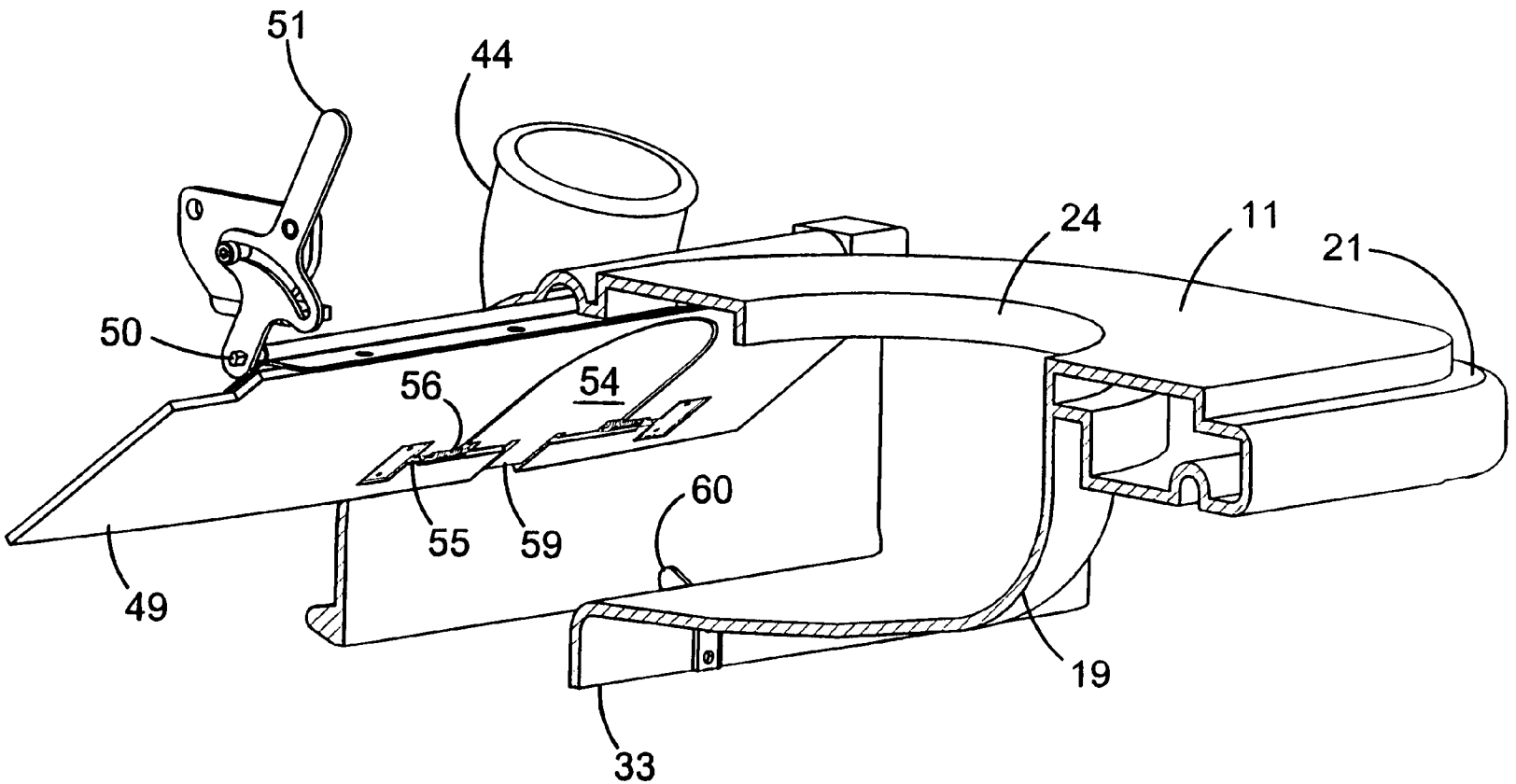
FIG. 5 is a perspective view of the apparatus of FIG. 2, taken from the upper, rear and left side, with the deck in vertical cross section and the apparatus in the ground pick-up mode.
Figure 6:
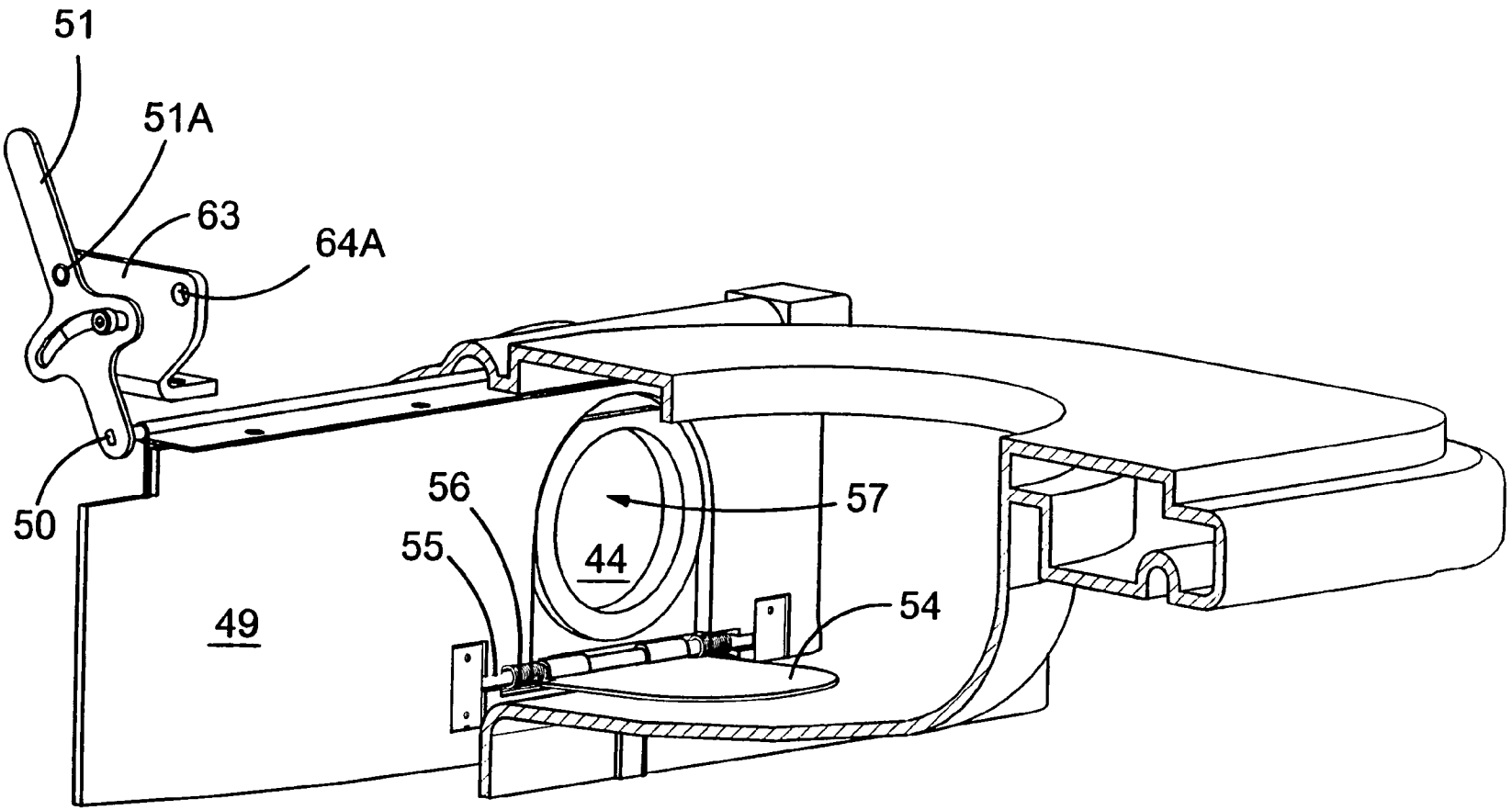
FIG. 6 is a view similar to FIG. 5, with the actuator converted to the hose-intake mode.

Turning to FIGS. 4-6, a second door or flap 54 is mounted by means of a spring-based shaft 55 to the lower or rear surface of the main door 49 (i.e. remote from the hose connector 44). A spring 56 (FIG. 6) received on the shaft 55 biases the second door 54 in a counter-clockwise direction as seen in FIG. 4, so that the second door 54 normally engages the rear surface of the main door 49 and covers and seals an opening 57 (FIG. 6) in the main door 49. Opening 57 is adjacent the intake opening of the hose connector 44 mounted to and carried by the main door 49, and air flows through opening 57 and hose connector 44 in the hose intake position of FIG. 7 to apply suction to the hose.

Referring now to FIG. 5, the second door 54 includes a lower, central tab designated 59 which is aligned with and engages an actuator 60 (see also FIGS. 7 and 8) mounted to the downwardly turned edge 33 of the bottom wall 32 of the plenum 19 beneath the opening 53 (see also FIG. 5).

Turning now to FIGS. 2 and 6, a mounting plate or bracket 63 is mounted to the top surface of the platform 21, adjacent the left front corner where the actuator lever 51 is located. The upper portion of the plate 63 has two holes, 64 (FIG. 2) and 64A (FIG. 6) which are adapted to receive and seat a pin 51A mounted to the actuator 51. The actuator 51 includes a curved opening 66 which receives a bolt 67 having a head which engages the actuator 51 adjacent the opening 66. The bolt 67 is spring-biased to urge the actuator 51 toward the plate 63 to seat the pin 51A when it is aligned with one of the holes 64, 64A.

As described, the lower end of the actuating lever 51 is rigidly pressed onto the shaft 50 (FIG. 2) which actuates or swings the main door 49. In the position of FIGS. 2-5, the lever 51 is in the rear or clockwise position (when viewed from the left as seen in FIG. 2) with the pin 51A seated in the rear hole 64A of plate 63 (FIG. 6).

In this actuator position, the main door 49 is in the ground pick-up mode seen in FIG. 3 in which the intermediate opening 53 between the front of the plenum 19 and the ground level intake opening 34 is open. In this position, the second door 54 is rotated by spring 55 counter-clockwise to close the opening 57 in the main door 49, and thus prevent air from flowing through the hose connector 44 into the plenum 19. In short, the ground level intake opening 34 is in air-flow communication with the impeller 30, thereby coupling suction to the ground level intake opening 34, and routing debris and dust entrained in the intake air flowing through the snout 18, the intermediate opening 53, plenum 19 and impeller housing 12 into the discharge chute 46, to be collected in a conventional refuse container.

Figure 7:
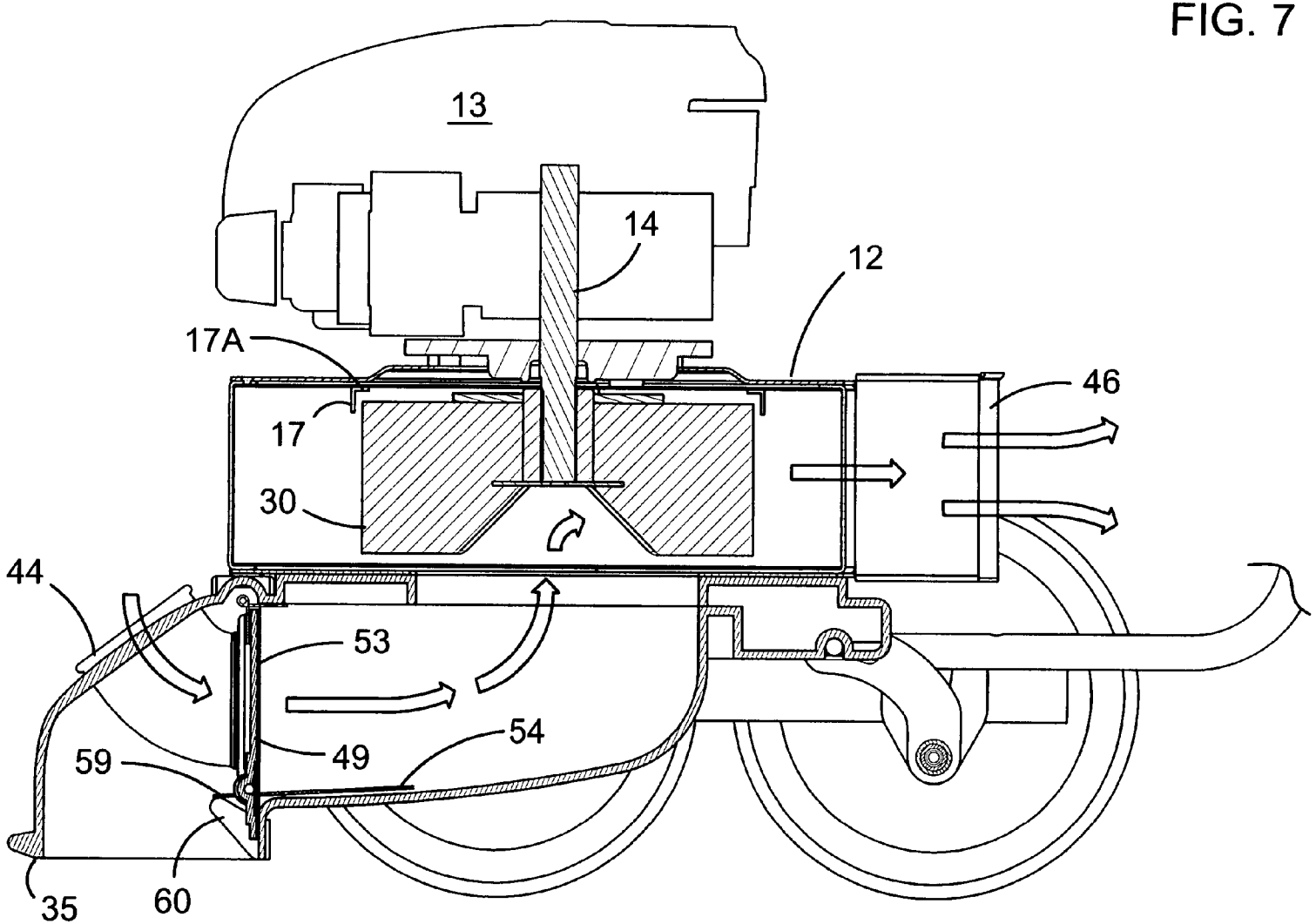
FIG. 7 is a view similar to FIG. 4, showing suction air flow with the actuator and main door in the hose intake mode.

By moving the actuator 51 slightly to the left or forward so that the pin 51A clears hole 64A in plate 65 (FIG. 6), the actuating lever 51 can be rotated counter-clockwise or forward about the axis of the shaft 50, thereby moving the main door 49 as well as the second door 54 counter-clockwise to the hose intake position shown in FIGS. 1, 6 and 7. In this position, intermediate opening 53 is closed by the main door 49 so that the ground level intake opening 34 is not in air-flow communication with the plenum 19 and impeller 30. Rather, the second door 54 is actuated (by virtue of the engagement between tab 59 with actuator tab 60) to the open position, as seen in FIGS. 6 and 7.

In this position, the second door 54 is rotated clockwise or rearward to a generally horizontal disposition, as seen in FIG. 6, thereby opening the aperture 57 in the main door. Rotation of the main door 49 to the hose intake position also carries the hose connector 44 to the hose intake position shown in FIG. 7 to provide direct air-flow communication between the flexible hose and the plenum 19 to deliver suction air, as well as debris entrained in the air, through the plenum 19, and the impeller housing 12 to the discharge spout 46. The actuator 51 is latched to the forward position when the pin 51A is received in the forward aperture 64 of plate 63 which is secured in that position once the operator releases the lever 51 due to the biasing force on the lever as described.

As an alternative to the lever actuator shown in the drawing, the plate 63 could have a turned upper edge to define stable forward and rear operating positions which are provided by the pin 51A and apertures 64, 64A in the illustrated embodiment. There are other, equally well suitable two-position actuators, such as sheathed cable actuators for performing this function, as persons skilled in the art will understand.

Other features may be included, if desired, such as a height-adjusting mechanism as illustrated in FIGS. 1 and 4, and safety devices for turning the engine off under certain conditions. However, they form no part of the present invention and are therefore not described.

Having thus disclosed in detail the illustrated embodiment of the invention, persons skilled in the art will appreciate that certain modifications may be made to the illustrated structure and equivalent elements substituted for those disclosed while continuing to practice the principle invention; and it is, therefore, intended that all such modifications and substitutions be covered as they are embraced within the spirit and scope of the appended claims.

We claim:

1. A vacuum machine suitable for outdoor use comprising:

a housing defining an air flow plenum having an inlet opening; a snout providing a ground level intake and in air flow communication with said plenum through said inlet opening; a suction source mounted to said housing; a main door mounted for motion between a first position in non-sealing relation with said inlet opening of said plenum and a second position in sealing relation with said inlet opening of said plenum, said main door defining an opening; a second door carried by said main door for motion between a first position in which said second door closes said opening in said main door, and a second position in which said opening in said main door is open; a hose connector carried by said second door and receiving a hose external of said machine; and a first actuator opening said second door when said main door is placed in said second position, thereby placing said hose in air flow communication with said suction source when said main door inhibits air flow through said ground level intake.

2. The machine of claim 1 further including ground-engaging wheels supporting said machine, wherein said ground level intake is generally horizontal in use and supported by said wheels in spaced relation from ground traversed by said wheels.

3. The machine of claim 1 wherein said inlet opening of said plenum is generally upright in use and said main door is pivotally mounted to said snout above said ground level intake.

4. The machine of claim 3 further comprising a second actuator externally accessible to an operator for moving said main door between said first and second positions.

5. The machine of claim 4 wherein said second actuator comprises a lever coupled to said main door and mounted for pivotal motion; and a bracket mounted to said housing for releaseably securing said lever in one of a first and second position corresponding respectively with said first and second positions of said main door.

6. The machine of claim 4 wherein said second door is pivotally mounted to a rear side of said first door; and further including a spring urging said second door to a closed position to cover and seal said opening in said first door.

7. The machine of claim 6 further comprising a second spring biasing said first door to said first position.

8. The machine of claim 7 wherein said first actuator comprises a tab mounted to said plenum adjacent a rear side of ground level intake.

9. The machine of claim 1 wherein said suction includes an impeller within said housing; a motor driving said impeller having blades; and a wrap protection member secured to said housing and extending about upper free ends of said impeller blades to prevent sheet material from wrapping about said impeller blades.

* * * * *